US008156747B2

(12) United States Patent
Lee

(10) Patent No.: US 8,156,747 B2
(45) Date of Patent: Apr. 17, 2012

(54) SUPPLY METHOD WITHOUT COOLING MEDIUM FOR AN AIR CONDITIONER AND A SYSTEM THEREOF

(75) Inventor: Jack Lee, Taichung (TW)

(73) Assignee: Po-Huei Chen, Chang Hua Hsien (TW)

( * ) Notice: Subject to any disclaimer, the term of this patent is extended or adjusted under 35 U.S.C. 154(b) by 1033 days.

(21) Appl. No.: 12/058,747

(22) Filed: Mar. 30, 2008

(65) Prior Publication Data

US 2009/0241563 A1 Oct. 1, 2009

(51) Int. Cl.
*F25D 17/06* (2006.01)

(52) U.S. Cl. ..... 62/93; 62/238.2

(58) Field of Classification Search ..... 62/5, 86, 62/93, 401, 402, 404, 238.2; 34/72, 298
See application file for complete search history.

(56) References Cited

U.S. PATENT DOCUMENTS 2,522,787 A * 9/1950 Hughes ..... 62/5
2,741,899 A * 4/1956 Von Linde ..... 62/5
2,971,342 A * 2/1961 Pilcher ..... 62/5
3,815,375 A * 6/1974 Inglis ..... 62/5
3,968,659 A * 7/1976 Pilcher ..... 62/5
4,283,916 A * 8/1981 Bassotti ..... 62/5
4,302,949 A * 12/1981 Trimboli Longhetto ..... 62/402
4,333,754 A * 6/1982 Peter ..... 62/5
4,584,838 A * 4/1986 AbuJudom, II ..... 62/5
4,723,970 A * 2/1988 Yokoyama ..... 96/409

* cited by examiner

*Primary Examiner* — Mohammad Ali

(57) ABSTRACT

A supply method without cooling medium for an air conditioner comprises the steps of removing moisture, separating cold air from hot air and supplying. Under the condition of no cooling medium, the above-mentioned steps separate the moisture from the compressed air, separate the cold air from the hot air and supply the cold air and the hot air. The system using the supply method without cooling medium for an air conditioner comprises at least one air dryer having an air-moisture separation chamber for separating air from moisture and at least one separator having a separation chamber for separating cold air from hot air. The separator is connected to a pipeline to supply the cold air and the hot air. Thereby, the environment will not be destroyed, and the cold and hot air are supplied separately, which allows the user to use the cold or hot air according to his/her requirement.

8 Claims, 11 Drawing Sheets

SUPPLY METHOD WITHOUT COOLING MEDIUM FOR AN AIR CONDITIONER AND A SYSTEM THEREOF

BACKGROUND OF THE INVENTION

1. Field of the Invention

The present invention relates to a supply method for an air conditioner and a system thereof, and more particularly to a supply method without cooling medium for an air conditioner and the system thereof.

2. Description of the Prior Art

The current air conditioner appeared in the market usually comprises a compressor, a condenser, an expansion valve (or a capillary tube) and an evaporator, and all these members of the air conditioner are connected to one another. When the air conditioner is working, the condenser performs an exothermic reaction to provide hot air, and the evaporator performs an endothermic reaction to provide cold air, such that the condenser and the evaporator can be selectively used to produce cold or hot air according to user's requirement.

However, the above-mentioned air conditioner still has the following disadvantages: the air conditioner can only be worked by using cooling medium, but the cooling medium is one of the factors to destroy the ozonosphere. As a result, the earth is directly exposed to a great amount of ultraviolet radiation, which will cause physiological and psychological harm to the biology live on the earth. Therefore, how to solve the above-mentioned problems has become an important issue for the manufacturers.

The present invention has arisen to mitigate and/or obviate the afore-described disadvantages.

SUMMARY OF THE INVENTION

The primary objective of the present invention is to provide a supply method without cooling medium for an air conditioner and a system thereof, wherein an air-moisture separator is used to separate the moisture from the compressed air, a separator is used to separate cold air from hot air, and finally the cold air and the hot air are supplied separately.

To achieve the objective of the present invention, the supply method without cooling medium for an air conditioner comprises the following steps:

removing moisture: guiding compressed air to a guiding space having at least two sizes of cross sections, with the variation of the cross sections of the guiding space, the compressed air will be collided in the guiding space, such that the flow rate of air is changed, so as to separate the moisture from the compressed air;

separating cold air from hot air: rotating the air produced by the step of removing moisture at a high speed, with the centrifugal force produced by rotation, the cold air and the hot air are separated;

supplying: separating the cold air and the hot air which are produced by the step of separating cold air from hot air, and supplying the cold air and the hot air separately.

A system using the above-mentioned supply method without cooling medium for an air conditioner comprises at least one air dryer and one separator. The air dryer is defined with an inlet and an outlet and is formed with a receiving space. The inlet is provided for guiding the compressed air. In the receiving space is provided an air-moisture separation chamber having at least two guiding spaces that are connected with each other. The inlet and the outlet of the air dryer are connected to the air-moisture separation chamber, so as to separate the moisture from the compressed air. The separator is provided with a separation chamber and is defined with an inlet, a cold outlet and a hot outlet. The inlet, the cold outlet and the hot outlet of the separator are connected to the separation chamber. The inlet of the separator is connected to the outlet of the air dryer, so as to separate the cold air from the hot air. The hot outlet and the cold outlet of the separator are connected by a pipeline to supply the cold air and the hot air separately.

With the above-mentioned method and system, the present invention has the following advantage: the system using the supply method without cooling medium for an air conditioner is capable of separating the moisture from the compressed air and separating the cold air from the hot air without using cooling medium, which is environment friendly and can reduce the harm to the earth's environment and biology.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
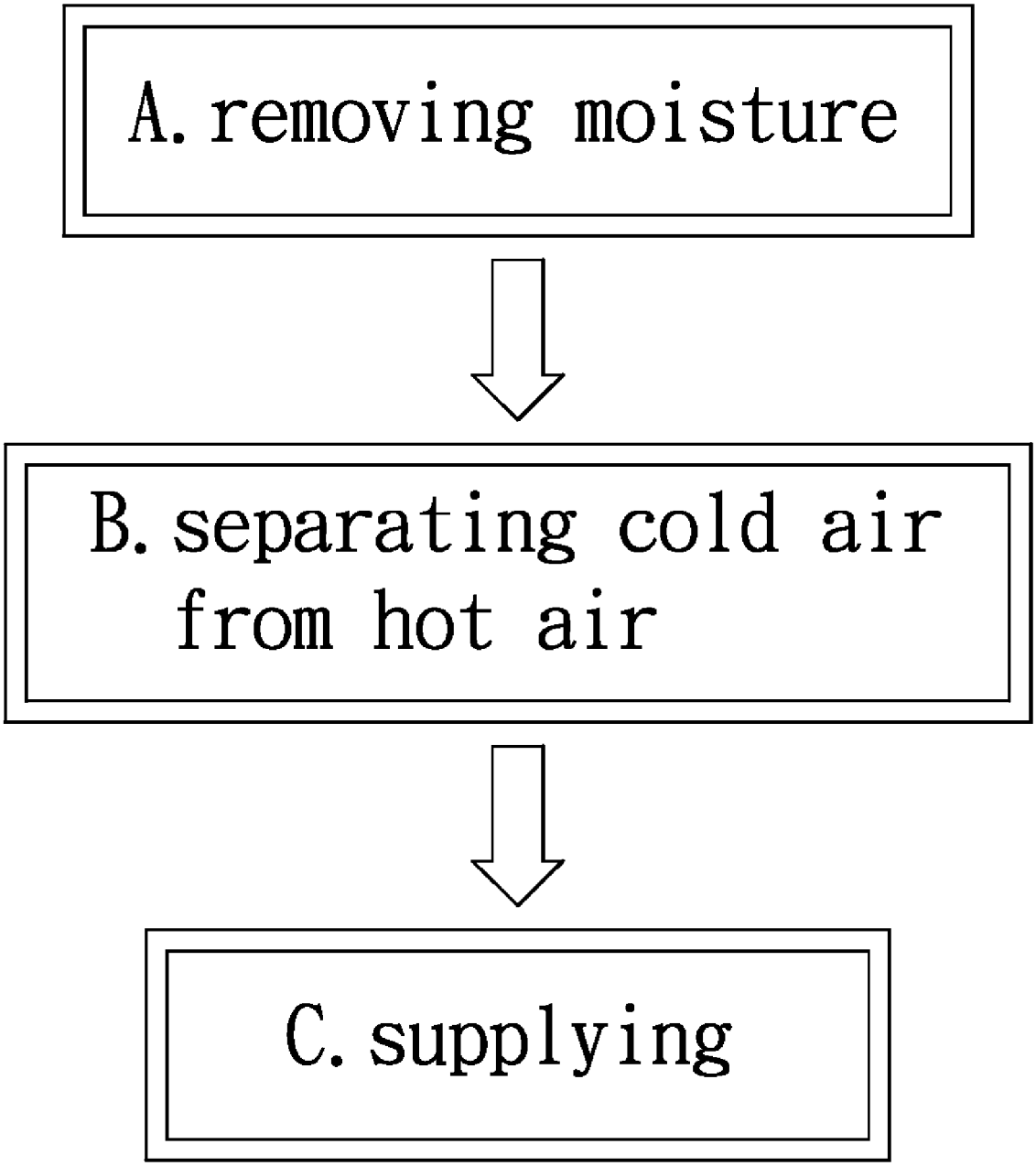
FIG. 1 is a flow chart of a supply method without cooling medium for an air conditioner in accordance with the present invention.

Referring to FIG. 1, a supply method without cooling medium for an air conditioner in accordance with the present invention comprises the following steps:

removing moisture: guiding compressed air to a guiding space having at least two sizes of cross sections, with the variation of the cross sections of the guiding space, the compressed air will be collided in the guiding space, such that the flow rate of air is changed, so as to separate the moisture from the compressed air;

separating cold air from hot air: rotating the air produced by the step of removing moisture at a high speed, with the centrifugal force produced by rotation, the cold air and the hot air are separated;

supplying: separating the cold air and the hot air which are produced by the step of separating cold air from hot air, and supplying the cold air and the hot air separately.

Figure 2:
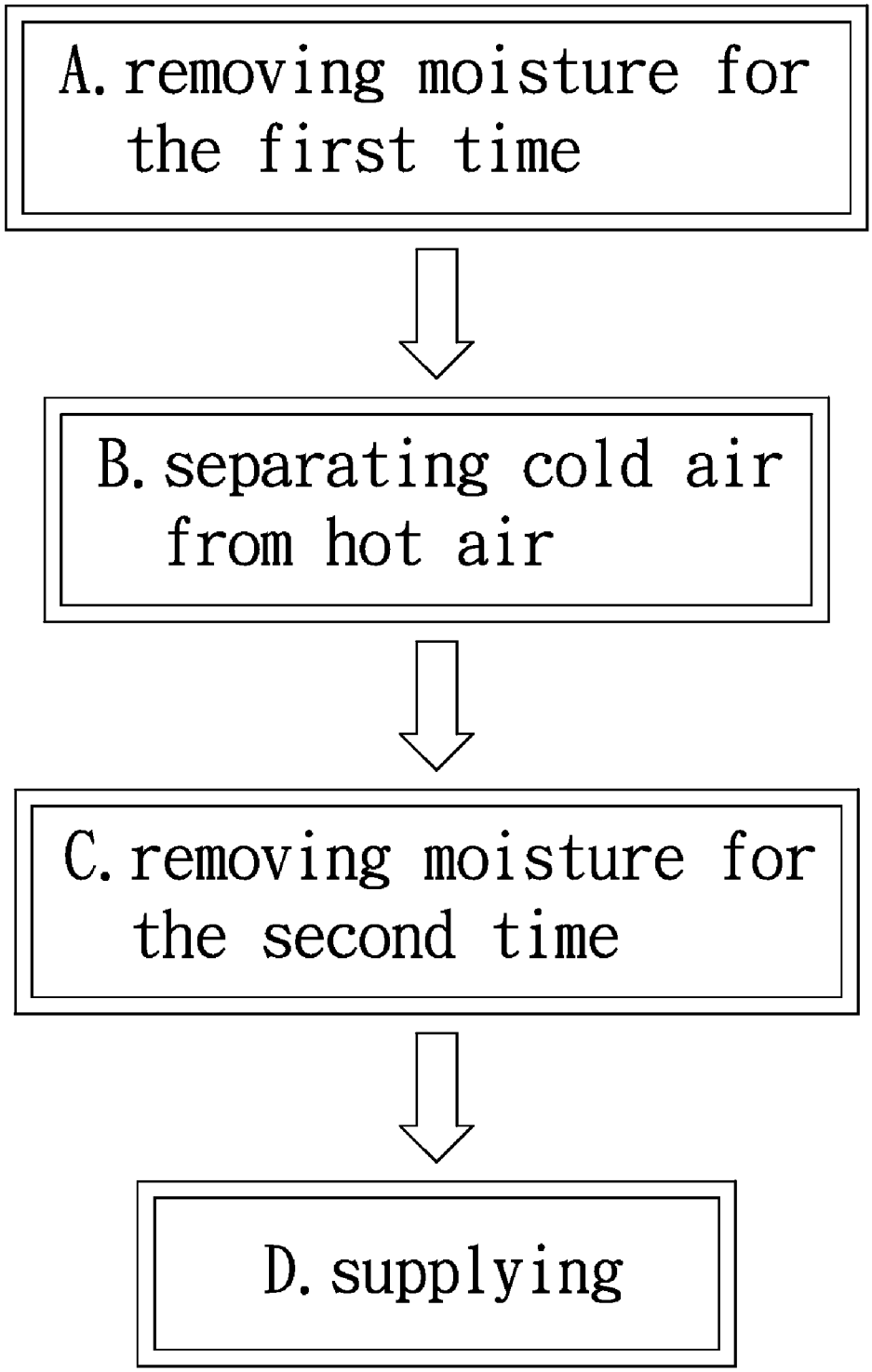
FIG. 2 is a flow chart of the supply method without cooling medium for an air conditioner in accordance with the present invention.

The following supply method without cooling medium for an air conditioner comprises an additional water-removing step (as shown in FIG. 2) that makes the following method different from the above-mentioned method, which comprises the steps of:

removing moisture for the first time: guiding compressed air to the guiding space having at least two sizes of cross sections. With the variation of the cross sections of the guiding space, the compressed air will be collided in the guiding space, such that the flow rate of air is changed, so as to separate the moisture from the compressed air;

separating cold air from hot air: rotating the air produced by the step of removing moisture at a high speed, with the centrifugal force produced by rotation, the cold air and the hot air are separated;

removing moisture for the second time: guiding the cold air produced by the step of separating cold air from hot air to the guiding space having at least two sizes of cross sections. With the variation of the cross sections of the guiding space, the compressed air will be collided in the guiding space, such that the flow rate of air is changed, so as to separate the moisture from the compressed air;

supplying: separating the cold air produced by the second water-removing step from the hot air produced by the step of separating cold air from hot air, and supplying the cold air and the hot air separately.

The above-mentioned second moisture-removing step is designed for large flow rate and can be avoided when the flow rate is small.

A system using the above-mentioned supply method without cooling medium for an air conditioner comprises a plurality of air dryers 10, a separator 20 and a cooperating body A.

Figure 3:
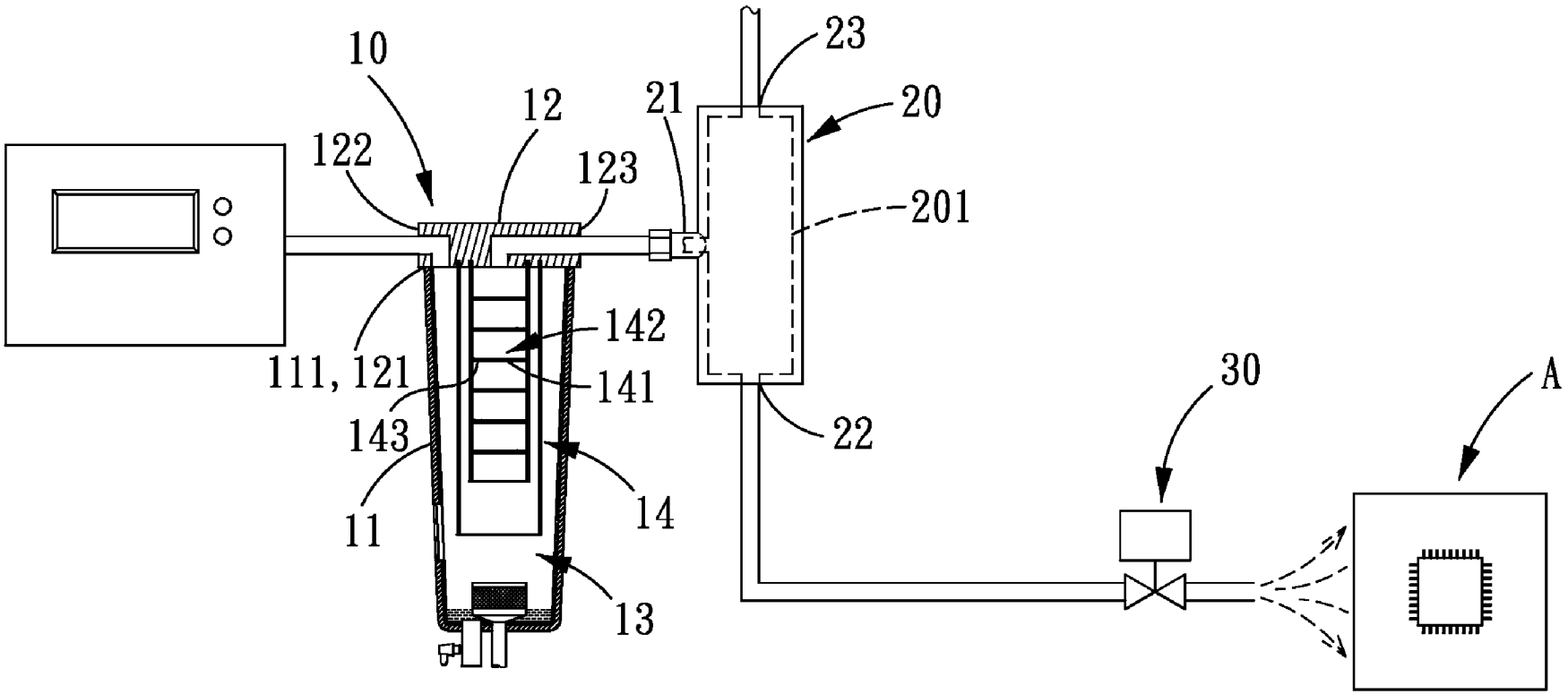
FIG. 3 is an illustrative view showing the supply of cold air by cooperating with a cooperating body in accordance with the present invention.

Referring to FIG. 3, the air dryer 10 comprises a cylinder 11 and a cover 12. One side of the cylinder 11 is provided with an assembling portion 111, and one side of the cover 12 is provided with an assembling portion 121. Each of the assembling portions 111, 121 is formed with a thread section for enabling the cylinder 11 and the cover 12 to be screwed with each other. The cover 12 is defined with an inlet 122 and an outlet 123. The cylinder 11 is combined with the cover 12 to form a receiving space 13. The cylinder 11 can also be integral with the cover 12 to form the receiving space 13 without the assembling portions 111, 121.

In the receiving space 13 is provided an air-moisture separation chamber 14 having at least one laminar separating member 141 which divides the air-moisture separation chamber 14 into at least two guiding spaces 142. The separating member 141 is defined with an air hole 143, such that the guiding spaces 142 are connected with each other. The air holes 143 of the separating members 141 must be arranged in a stagger manner, such that the compressed air moves in a tortuous pattern in the guiding spaces 142 to increase the times of collision, thus further increasing the adhesion amount of moisture and oil gas. The inlet 122 and the outlet 123 of the cover 12 are connected to both ends of the air-moisture separation chamber 14, such that the compressed air flows into the inlet 122 of the cover 12, then passes through the air hole 143 of each separating member 141 of the air-moisture separation chamber 14, and finally is discharged from the outlet 123 of the cover 12.

The separator 20 is provided with a separation chamber 201 and is defined with an inlet 21, a cold outlet 22 and a hot outlet 23. The inlet 21, the cold outlet 22 and the hot outlet 23 are connected to the separation chamber 201. The cold outlet 22 and the hot outlet 23 are located at both ends of the separation chamber 201, and the inlet 21 is provided at one side of the separation chamber 201 and is connected to the outlet 123 of the air dryer 10.

Figure 4:
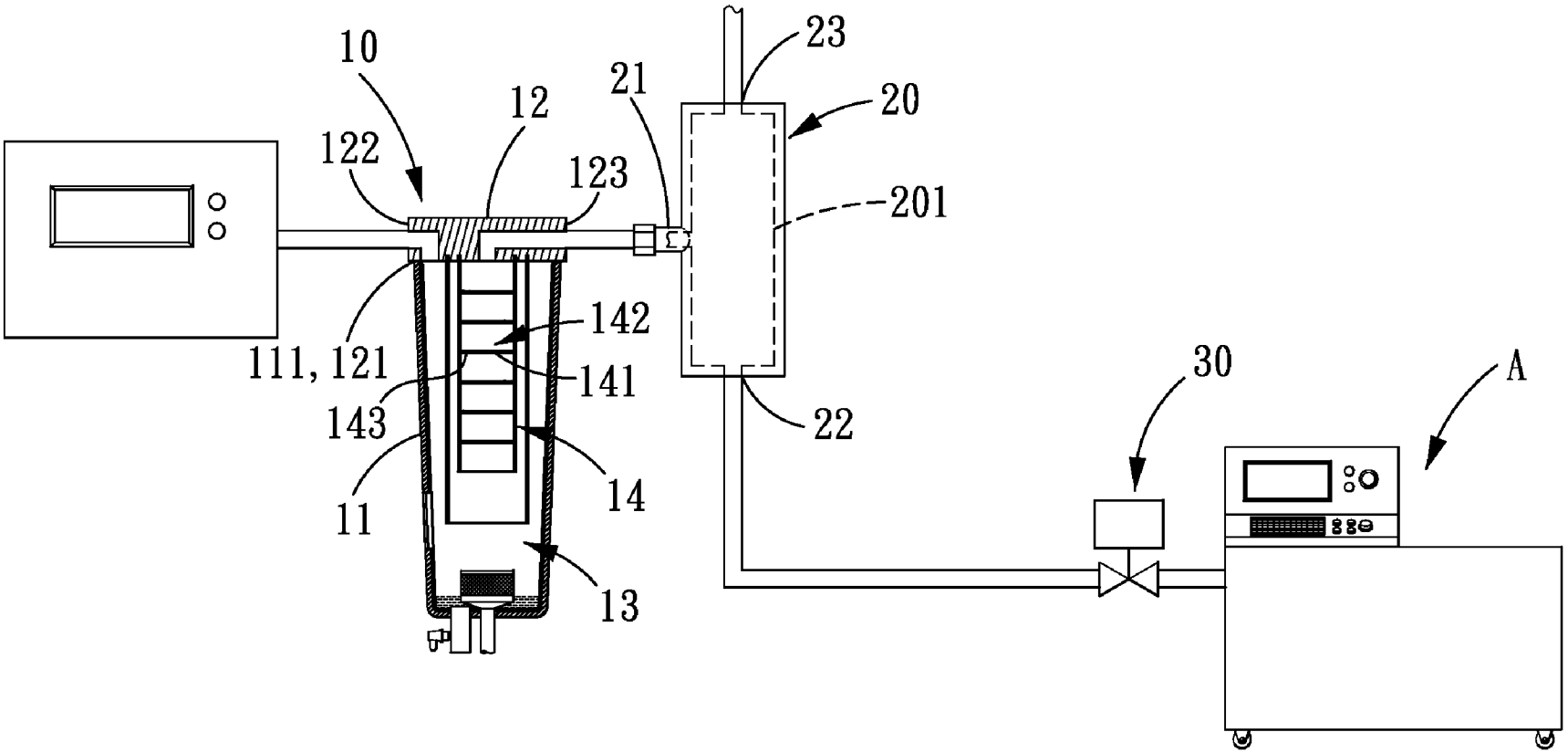
FIG. 4 is an illustrative view showing the supply of the cold air by cooperating with the cooperating body in accordance with the present invention.
Figure 5:
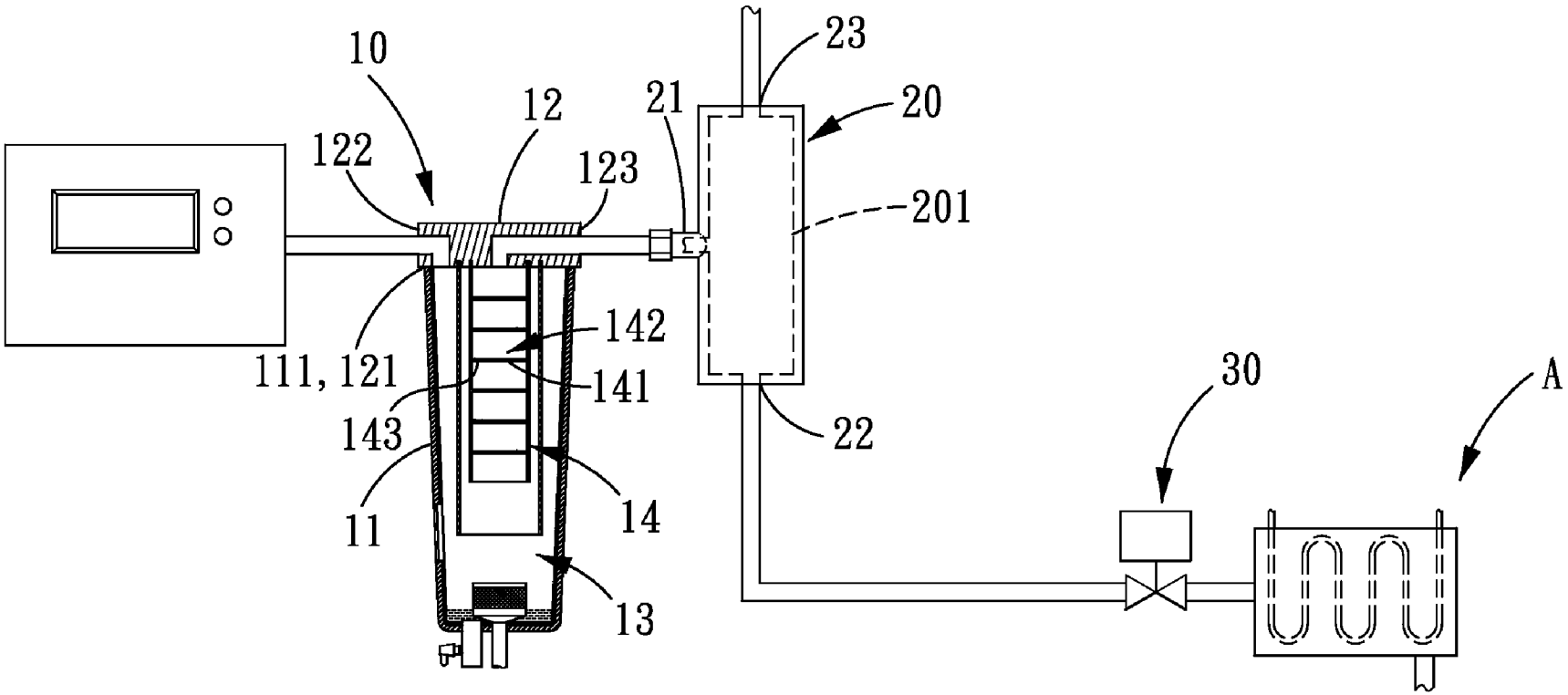
FIG. 5 is an illustrative view showing the supply of the cold air by cooperating with the cooperating body in accordance with the present invention.
Figure 6:
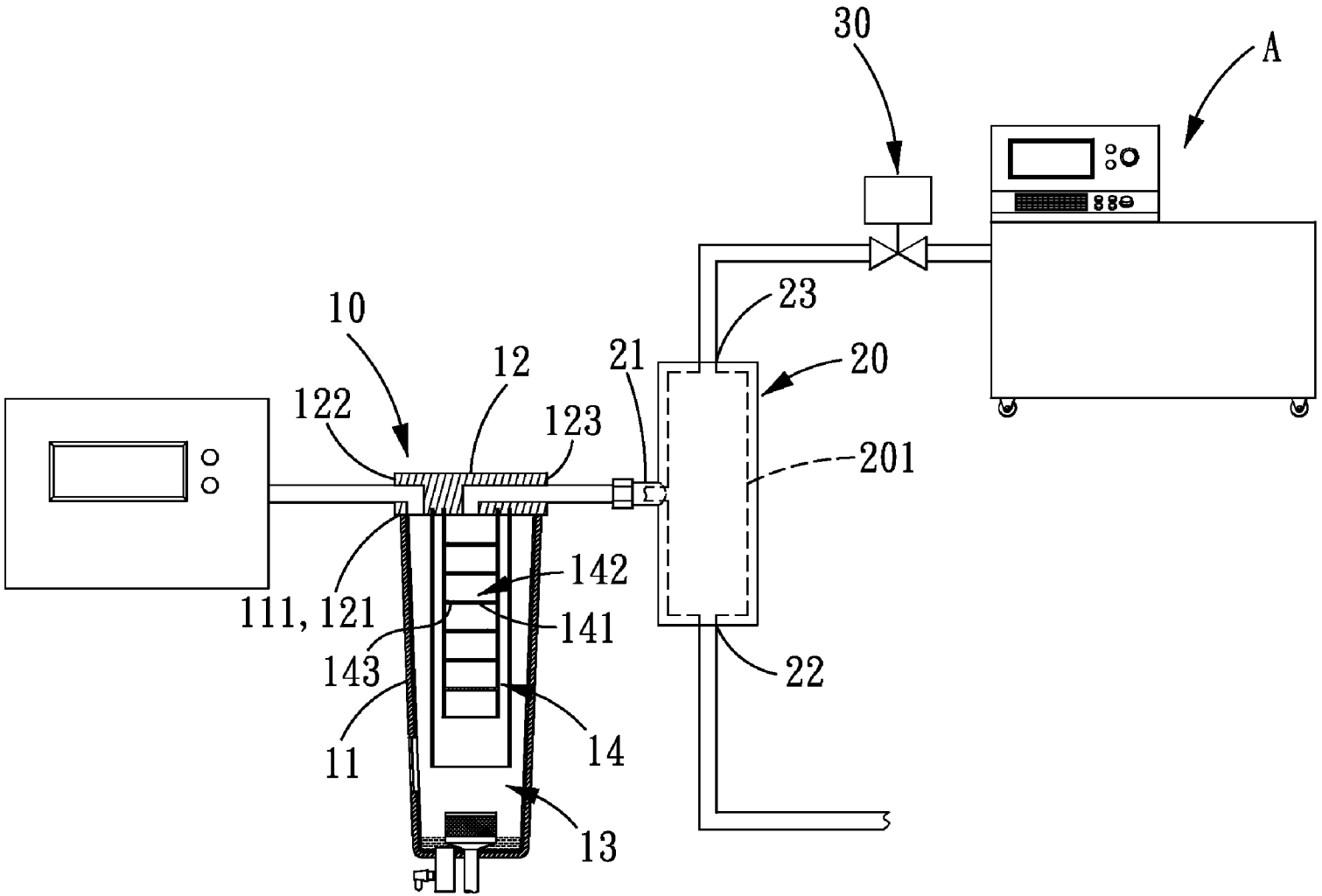
FIG. 6 is an illustrative view showing the supply of hot air by cooperating with the cooperating body in accordance with the present invention.
Figure 7:
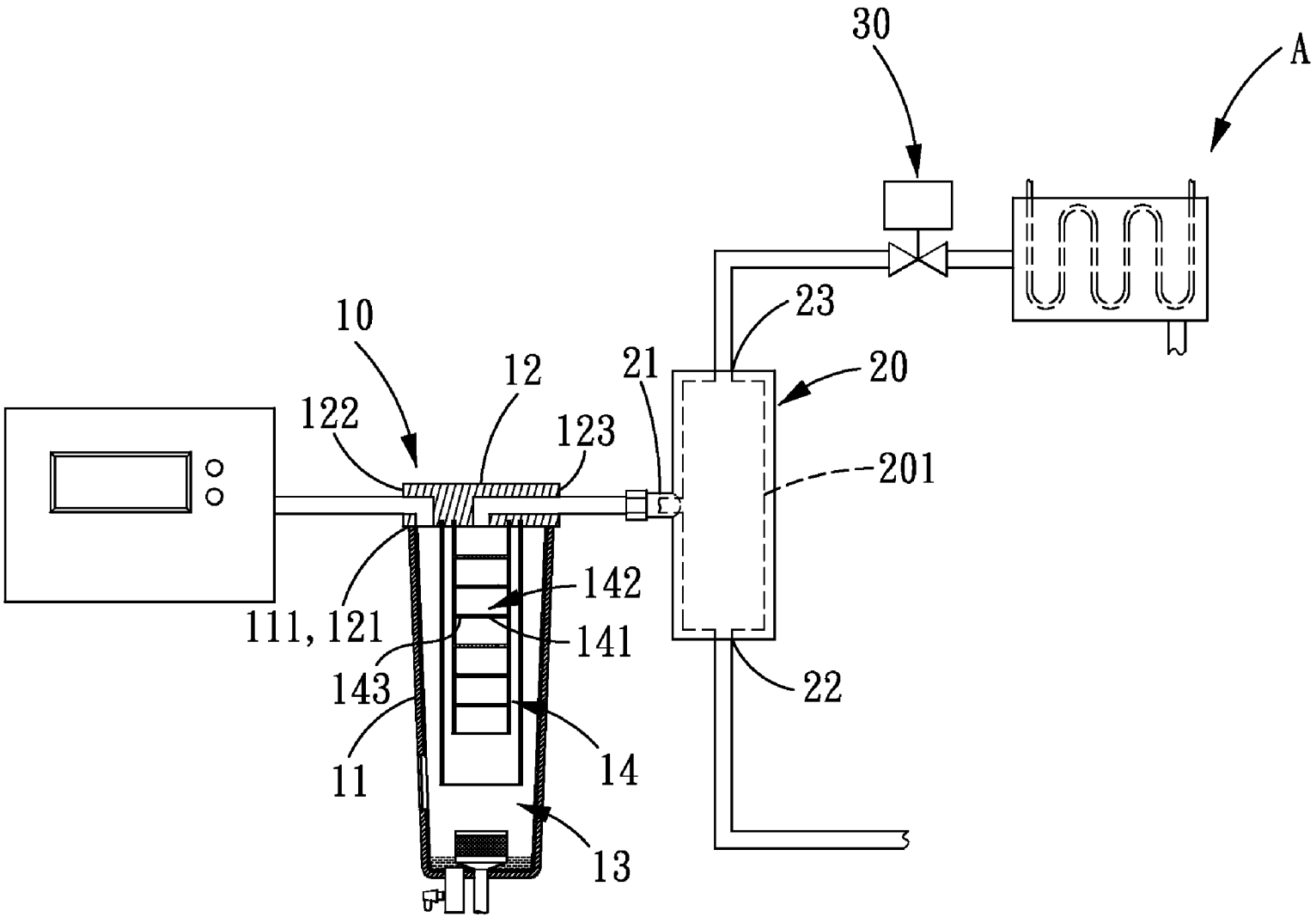
FIG. 7 is an illustrative view showing the supply of the hot air by cooperating with the cooperating body in accordance with the present invention.

When the air enters the separation chamber 201 from the inlet 21 of the separator 20, it is sprayed out from the inlet 21 into the separation chamber 201 and then rotates in the separation chamber 201 at a high speed, so as to produce a centrifugal force. With the effect of the centrifugal force, the pressure and density of the air close to an inner wall of the separation chamber 201 will be increased, and the pressure and density of the air away from the inner wall of the separation chamber 201 will be decreased, such that the air with high pressure and density will flow to the air with low pressure and density. With the pressure change in the separation chamber 201, the hot air will be discharged from the hot outlet 23, and the cold air will be discharged from the cold outlet 22. The hot outlet 23 provides hot air to the cooperating body A, or the cold outlet 22 provides cold air to the cooperating body A. The cooperating body A can be a chip (as shown in FIG. 3) or a tool machine (as shown in FIGS. 4 and 6). The cold outlet 22 and the hot outlet 23 can be used in the air conditioner as a medium for providing or absorbing heat energy, thus replacing the cooling medium which destroys the earth's environment. Moreover, the cold outlet 22 and the hot outlet 23 can also cooperate with liquid, such as water (industrial water or living water) to provide cold water (as shown in FIG. 5) or hot water (as shown in FIG. 7) via thermal exchange.

Referring to FIG. 3 again, in order to adjust the air flow rate of the hot outlet 23 and the cold outlet 22 of the separator 20, the diameter of the pipelines provided at the hot outlet 23 and the cold outlet 22 can also be designed to be changeable to restrict the flow rate, for example, the diameter of the hot outlet 23 of the separator 20 can be larger than, or smaller than or equal to that of the cold outlet 22. Also, each of the hot outlet 23 and the cold outlet 22 can be assembled with a control valve 30 having a changeable opening to restrict the flow rate.

Figure 8:
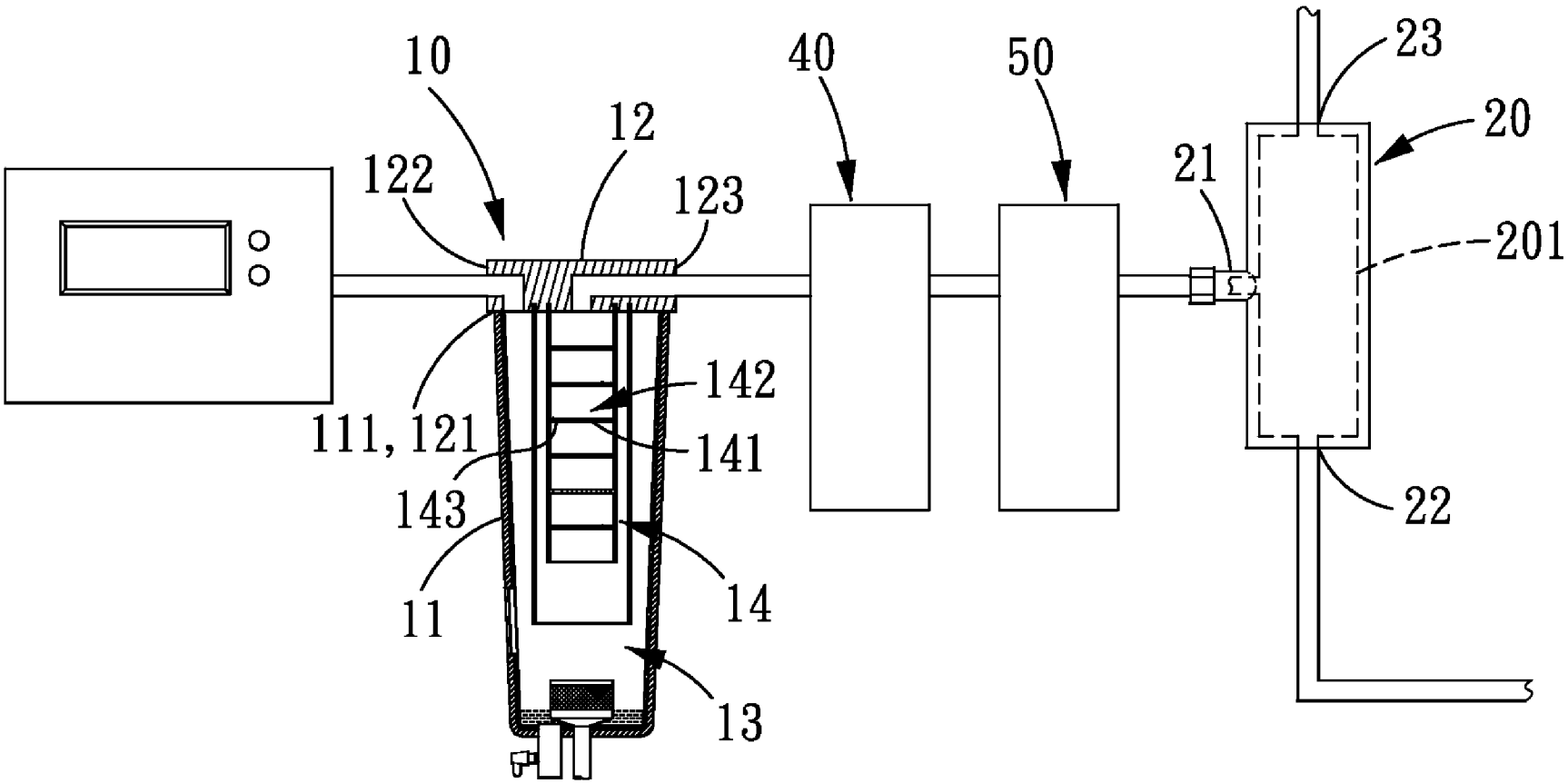
FIG. 8 is an assembly perspective view showing a dust filter and a bacterial filter being assembled to a system using the supply method without cooling medium for an air conditioner in accordance with the present invention.

Referring to FIG. 8, a dust filter 40 and a bacterial filter 50 are assembled between the air dryer 10 and the separator 20, so as to filter the dust and bacteria in the pipelines, providing a healthier and cleaner air.

Figure 9:
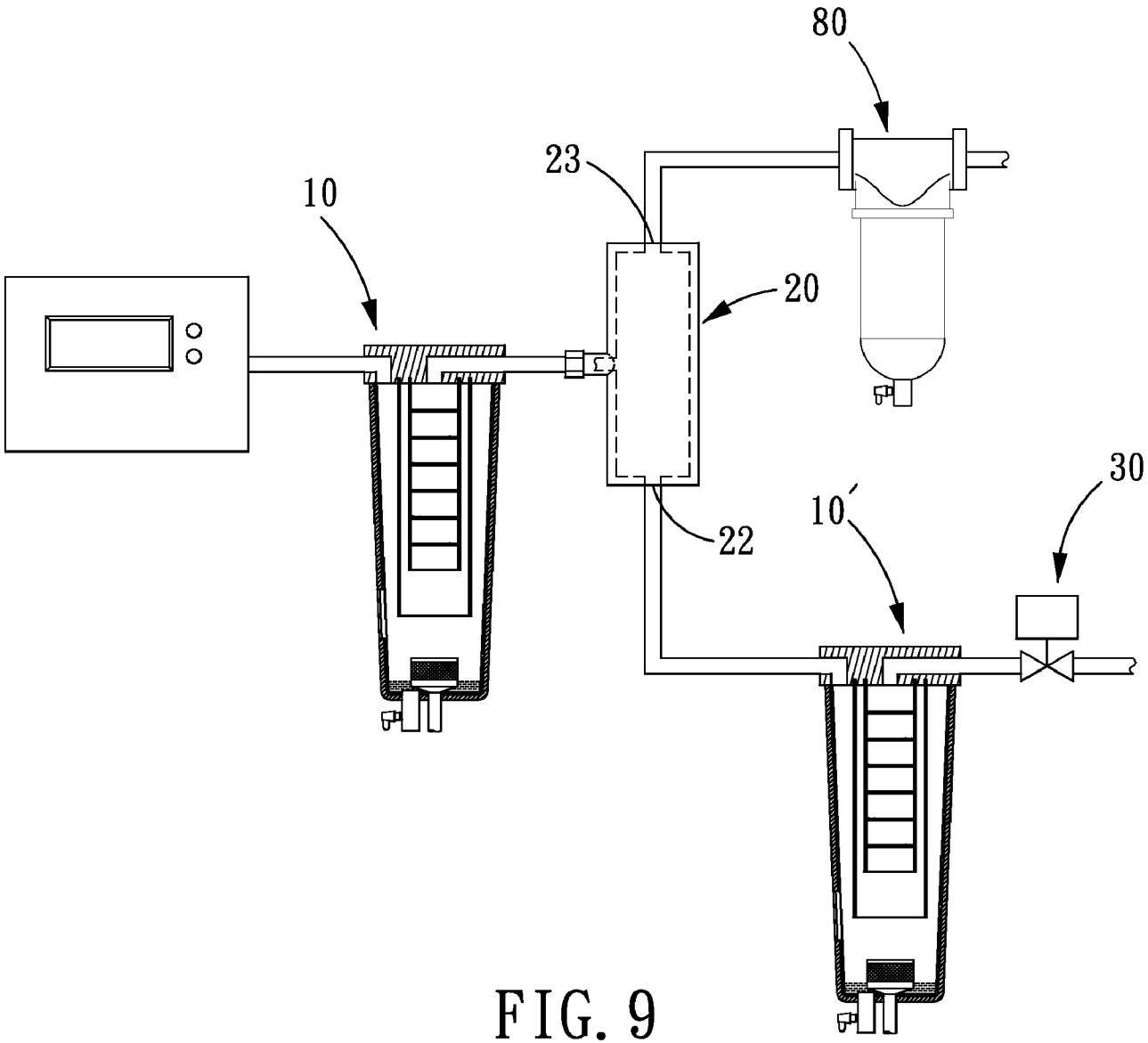
FIG. 9 is an assembly perspective view showing an air dryer being assembled to the system using the supply method without cooling medium for an air conditioner in accordance with the present invention.

Referring to FIG. 9, in order to process compressed air of high flow rate, the cold air discharged from the cold outlet 22 often contains moisture, at this moment, an air dryer 10' must be assembled to the cold outlet 22. The hot air discharged from the hot outlet 23 often contains oil gas, at this moment, an oil-gas separator 80 must be assembled to the hot outlet 23. The above-mentioned air dryer 10' and the oil-gas separator 80 can be selectively assembled according to the flow rate or oil gas content or moisture content of the compressed air.

Figure 10:
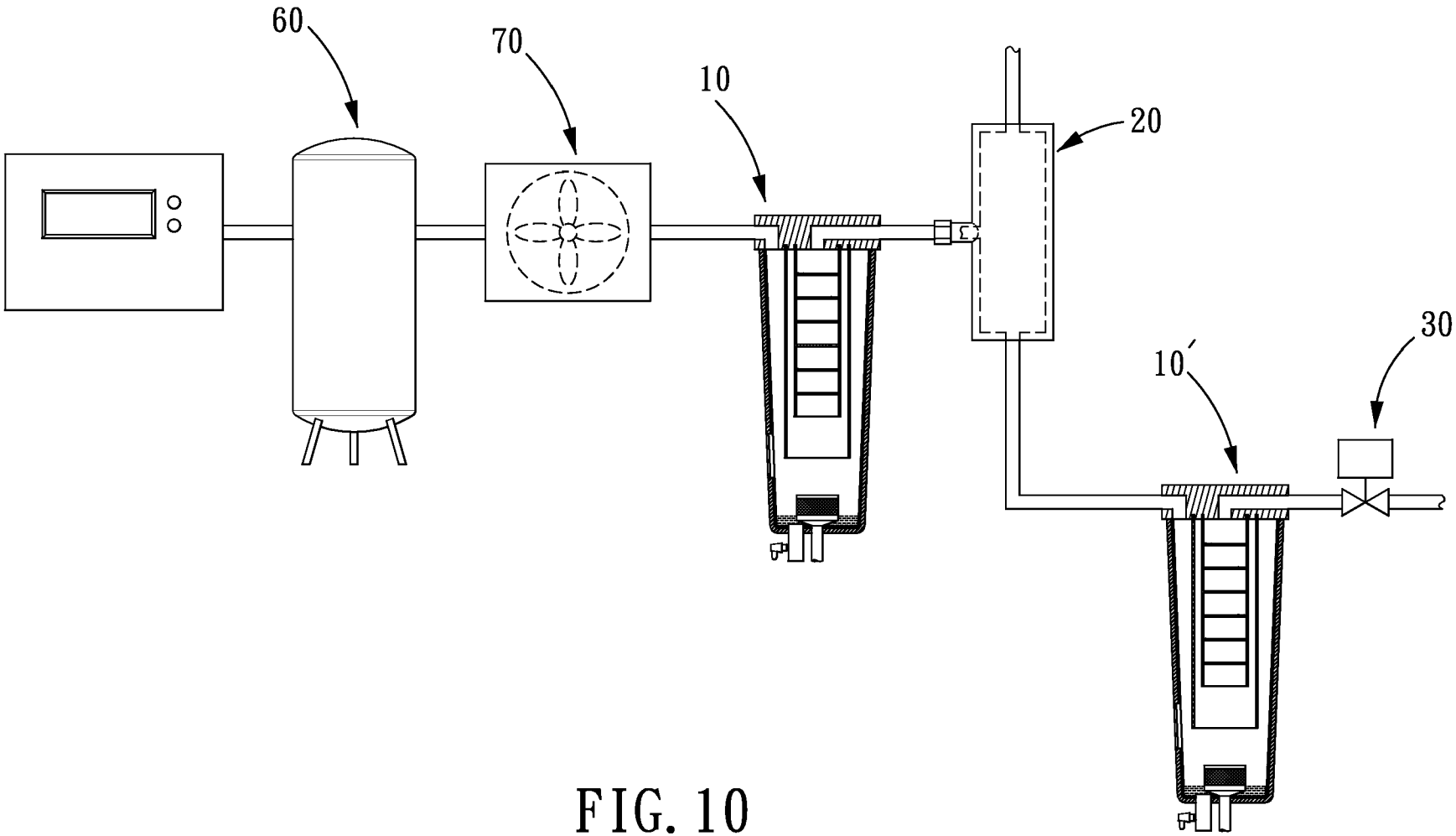
FIG. 10 is an assembly perspective view showing a fan and an air tank being assembled to the system using the supply method without cooling medium for an air conditioner in accordance with the present invention.
Figure 11:
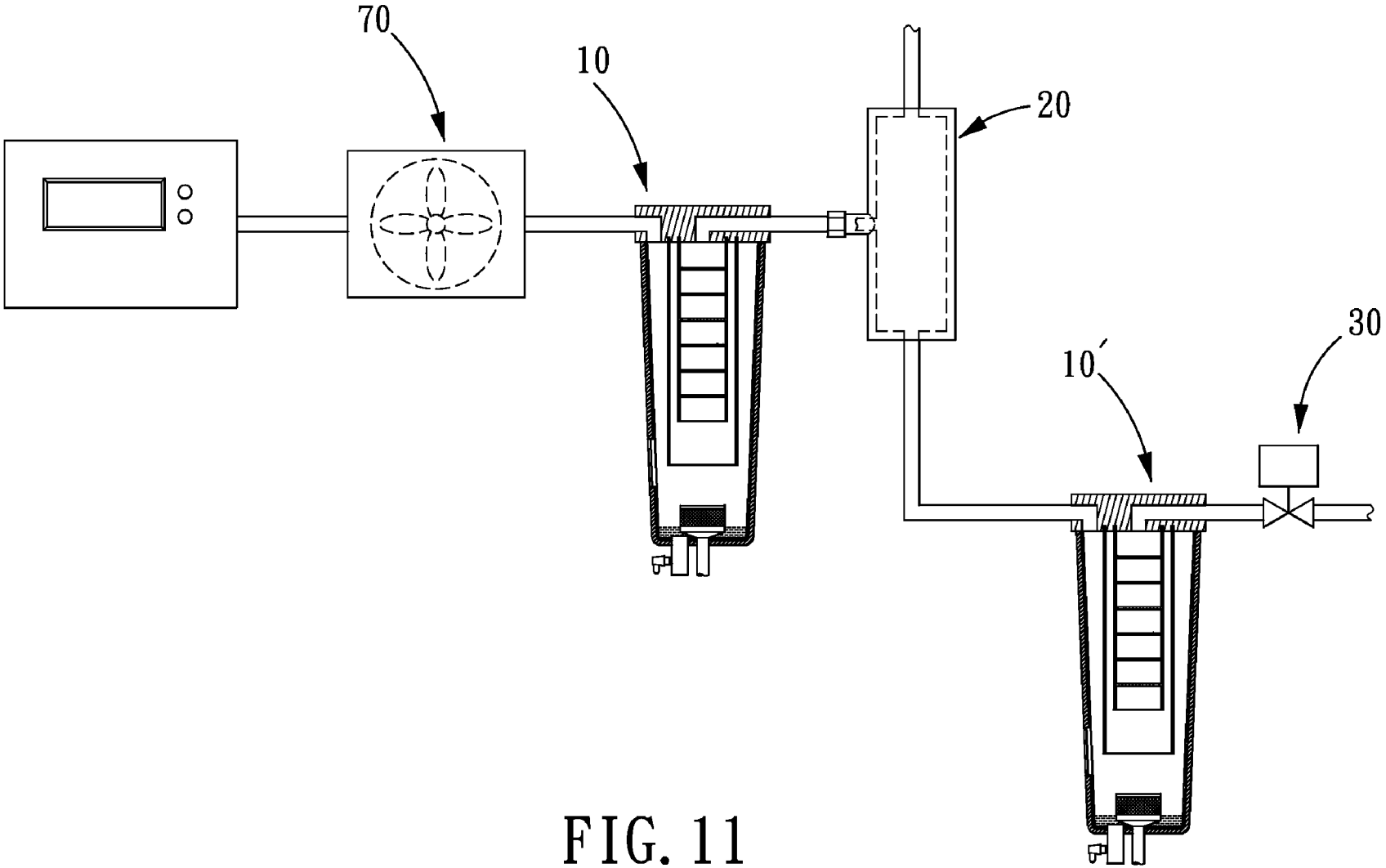
FIG. 11 is an assembly perspective view showing the fan being assembled to the system using the supply method without cooling medium for an air conditioner in accordance with the present invention.

Referring to FIG. 10, in order to adjust the temperature of the compressed air, the pipeline connected to the inlet 122 of the air dryer 10 is assembled with an air tank 60 into which the compressed air is guided, that is, the compressed air is guided from a small space to a large space, such that the flow rate of the compressed air is reduced, so as to achieve a cooling effect. The air tank 60 is also used to stabilize pressure of the compressed air. In addition, the pipeline connected between the air tank 60 and the air dryer 10 can be assembled with a fan 70 for dissipating its heat energy. Thereby, the air tank 60 and the fan 70 (as shown in FIG. 11) can be selectively used according to the flow rate and the temperature of the compressed air. Moreover, as to the air compressor A for manufacturing the compressed air which has been designed to have a function of cooling the compressed air, it is unnecessary to assemble the above-mentioned air tank 60 and fan 70.

To summarize, the supply method without cooling medium for an air conditioner comprises the steps of removing moisture, separating cold air from hot air and supplying. Under the condition of no cooling medium, the above-mentioned steps separate the moisture from the compressed air, separate the cold air from the hot air and supply the cold air and the hot air. The system using the supply method without cooling medium for an air conditioner comprises at least one air dryer having an air-water separation chamber for separating air from moisture and at least one separator having a separation chamber for separating cold air from hot air. The separator is connected to a pipeline to supply the cold air and the hot air. The present invention works without cooling medium can prevent the environment from being destroyed, and supplies the cold air and the hot air separately, which allows the user to use the cold air or the hot air according to his/her requirement.

While we have shown and described various embodiments in accordance with the present invention, it should be clear to those skilled in the art that further embodiments may be made without departing from the scope of the present invention.

What is claimed is:

1. A system using a supply method without cooling medium for an air conditioner, comprising:

at least one air dryer being defined with an inlet and an outlet and formed with a receiving space, the inlet of the air dryer being provided for guiding compressed air, in the receiving space being provided an air-moisture separation chamber being provided a plurality of separating members to divide the air-moisture separation chamber into a plurality of guiding spaces, each of the separating members being defined with an air hole, and the air holes of the separating members being arranged in a staggered manner, such that the guiding spaces are connected with each other, the inlet and the outlet of the air dryer being connected to the air-moisture separation chamber, so as to separate moisture from the compressed air;

at least one separator being provided with a separation chamber and defined with an inlet, a cold outlet and a hot outlet, the inlet, the cold outlet and the hot outlet of the separator being connected to the separation chamber, the inlet of the separator being connected to the outlet of the air dryer, so as to separate cold air from hot air, and each of the cold outlet and the hot outlet of the separator being connected by a pipeline, so as to supply the cold air and the hot air separately.

2. The system using a supply method without cooling medium for an air conditioner as claimed in claim 1, wherein a control valve is assembled to the hot outlet of the separator to restrict flow rate.

3. The system using a supply method without cooling medium for an air conditioner as claimed in claim 1, wherein a control valve is assembled to the cold outlet of the separator to restrict flow rate.

4. The system using a supply method without cooling medium for an air conditioner as claimed in claim 1, wherein an additional air dryer is assembled to a pipeline connected to the cold outlet of the separator.

5. The system using a supply method without cooling medium for an air conditioner as claimed in claim 1, wherein an oil-gas separator is assembled to a pipeline connected to the hot outlet of the separator.

6. The system using a supply method without cooling medium for an air conditioner as claimed in claim 1, wherein an air tank is assembled to a pipeline connected to the inlet of the air dryer.

7. The system using a supply method without cooling medium for an air conditioner as claimed in claim 1, wherein a fan is assembled to a pipeline connected to the inlet of the air dryer.

8. The system using a supply method without cooling medium for an air conditioner as claimed in claim 1, wherein an air tank and a fan are assembled to a pipeline connected to the inlet of the air dryer.

* * * * *